US011833659B2

(12) United States Patent
Fan et al.

(10) Patent No.: US 11,833,659 B2
(45) Date of Patent: Dec. 5, 2023

(54) LIFTING STORAGE DEVICE

(71) Applicant: Yantai Greenery Tools Co., Ltd., Yantai (CN)

(72) Inventors: Changlei Fan, Yantai (CN); Bo Yu, Yantai (CN); Hongquan Yin, Yantai (CN)

(73) Assignee: Yantai Greenery Tools Co., Ltd., Yantai (CN)

( * ) Notice: Subject to any disclaimer, the term of this patent is extended or adjusted under 35 U.S.C. 154(b) by 0 days.

(21) Appl. No.: 18/325,052

(22) Filed: May 29, 2023

(65) Prior Publication Data

US 2023/0302625 A1 Sep. 28, 2023

Related U.S. Application Data

(63) Continuation of application No. PCT/CN2023/070829, filed on Jan. 6, 2023.

(51) Int. Cl.
*B25H 3/02* (2006.01)

(52) U.S. Cl.
CPC ..... *B25H 3/026* (2013.01); *B25H 3/028* (2013.01)

(58) Field of Classification Search
CPC ..... B25H 3/028; B25H 3/026
USPC ..... 220/529; 312/266; 190/17
See application file for complete search history.

(56) References Cited

U.S. PATENT DOCUMENTS 1,499,741 A * 7/1924 Labadie ..... G09F 5/02 312/266
2,710,093 A * 6/1955 Raker ..... A01K 97/06 206/315.11
3,435,570 A * 4/1969 Berry ..... E04H 12/185 52/645
4,173,284 A * 11/1979 March ..... B25H 3/023 206/349
2009/0050589 A1 2/2009 Pedler et al.

FOREIGN PATENT DOCUMENTS

CN 210227396 U 4/2020
CN 210339166 U 4/2020
CN 114224084 A 3/2022
CN 217218461 U 8/2022

OTHER PUBLICATIONS

Internation Search Report of PCT/CN2023/070829, dated Mar. 31, 2023.

* cited by examiner

*Primary Examiner* — Rafael A Ortiz
*Assistant Examiner* — Sanjidul Islam

(57) ABSTRACT

A lifting storage device comprises multiple box bodies movably stacked up and down, X-shaped hinges are symmetrically arranged on two sides of the box body, a support frame slideway limiting plate is arranged below the box body, a bottom end of the X-shaped hinge is movably connected with the support frame slideway limiting plate, a box body front rotating shaft and a box body rear rotating shaft are arranged in front of and behind each box body, the front rotating shaft and the rear rotating shaft of each box body are connected with the X-shaped hinges in a staggered manner, each box body is obliquely lifted along with the X-shaped hinges after connection, a locking mechanism is arranged on the support frame slideway limiting plate corresponding to the X-shaped hinge and the locking mechanism is arranged in a final position of a slideway on the support frame slideway limiting plate.

6 Claims, 7 Drawing Sheets

LIFTING STORAGE DEVICE

CROSS-REFERENCE TO RELATED APPLICATIONS

This application is a continuation of International Patent Application No. PCT/CN2023/070829 with a filing date of Jan. 6, 2023, designating the United States, now pending, and further claims priority to Chinese Patent Application No. 202210079760.0 with a filing date of Jan. 24, 2022. The content of the aforementioned applications, including any intervening amendments thereto, are incorporated herein by reference.

TECHNICAL FIELD

The present invention relates to a lifting storage device, which is suitable for storing various daily articles and tools.

BACKGROUND OF THE PRESENT INVENTION

Article storage cabinet is a commonly used necessary storage object, having a cabinet-type, drawer-type or box-type structure commonly used at present. With the rapid development of science and technology, the storage cabinet has had more than a simple storage function, and many telescopic/lifting multi-purpose cabinets integrating storage, display and other functions have been developed in the market, such as a telescopic storage display box, a lifting article cabinet and other patented technologies applied by the inventor, in an effort to make the best use of everything, so as to meet the needs of different users. However, there are many defects in existing lifting article cabinets due to the immature technology, such as easy unstable shaking of a lifting mechanism, unstable lifting of a box body, large lifting resistance, a high wear rate between parts, which affect the market promotion and use.

SUMMARY OF PRESENT INVENTION

Technical Problem

The present invention aims to solve the problems in the prior art and provide a lifting storage device with a novel structure.

Technical Solution

A technical solution of the present invention is that: a lifting storage device comprises multiple bodies movably stacked up and down, X-shaped hinges are symmetrically arranged on two sides of the box body, a support frame slideway limiting plate is arranged below a bottom-layer box body, and a bottom end of the X-shaped hinge is movably connected with the support frame slideway limiting plate, wherein a box body front rotating shaft and a box body rear rotating shaft are respectively arranged in front of and behind each box body through connecting lugs, the box body front rotating shaft and the box body rear rotating shaft of each box body are respectively connected with the X-shaped hinges in a staggered manner, wherein two ends of the box body front rotating shaft are movably connected with lower-layer front hinge points of the X-shaped hinges on two sides, and two ends of the box body rear rotating shaft are movably connected with upper-layer rear hinge points of the X-shaped hinges on two sides, and each box body is obliquely lifted along with the X-shaped hinges after the box body front rotating shaft and the box body rear rotating shaft are connected with the X-shaped hinges.

A locking mechanism is arranged on the support frame slideway limiting plate corresponding to the X-shaped hinge, the locking mechanism is arranged in a final position of a slideway on the support frame slideway limiting plate, the locking mechanism comprises a deadbolt, a deadbolt hanging plate, a limiting catch and a torsion spring, the deadbolt is movably connected with the support frame slideway limiting plate through a rotating shaft, the deadbolt hanging plate and the limiting catch are arranged corresponding to the deadbolt, and the torsion spring is arranged in the deadbolt.

Further, an oil-free bushing is arranged in a rotating shaft hole of the hinge point of the X-shaped hinge.

Further, a grooved rolling bearing is arranged on the box body front rotating shaft of the bottom-layer box body, a slide rail is correspondingly arranged on the support frame slideway limiting plate, and the grooved rolling bearing is movably abutted with the slide rail.

Further, a bottom portion of the bottom-layer box body is provided with an oil pressure buffer, and an oil pressure buffer impact plate is correspondingly arranged on the support frame slideway limiting plate.

Further, a buffer limiting seat is arranged on the support frame slideway limiting plate.

Further, a rear portion of the support frame slideway limiting plate is provided with a limiting guide bracket, and the X-shaped hinge is movably abutted with the limiting guide bracket correspondingly.

Beneficial Effects

The present invention realizes improvement based on an existing lifting article cabinet, and compared with the prior art, the lifting is smoother and more stable, and the box body is more stable when the present invention is used. In the prior art, only a hanging shaft is mounted at a rear portion of the box body to be connected with the X-shaped hinge, a front portion of the box body is in a suspended state without support, and a freely drooped front edge of the upper-layer box body may be pressed on the lower-layer box body when the plurality of box bodies are lifted to an inclined state along with the X-shaped hinge, resulting in the limited display space. However, in the present invention, support rotating shafts are designed in front of and behind the box body, adjacent box bodies may be separated when lifted to be inclined along with the X-shaped hinge, the front edge of the upper-layer box body is no longer pressed on the lower-layer box body, an interior of the box body can be fully displayed, and an operable taking space between the box bodies is wider, so that taking operation is easier and more convenient. In addition, a stable quadrilateral structure is formed between the front and rear rotating shafts of the box body and the X-shaped hinge, which also improves a stability of the X-shaped hinge.

In the prior art, a lifting stroke of the X-shaped hinge is limited by a nitrogen spring and a sliding rod sleeve mechanism, with a good safety performance, but there are disadvantages of limited lifting stroke and height, limited display space of the box body and large sliding friction resistance in the process, which greatly affect the use. In the improvement by the present invention, the sliding rod sleeve mechanism is abandoned, and the lifting stroke of the X-shaped hinge is controlled by a length of the slideway on the support frame slideway limiting plate below the bottom-layer box body, so that no friction resistance exists during lifting, and the lifting is smoother, and the locking mechanism is added for locking, which may play a very good role in safety protection.

In order to make the running smoother, reduce friction and reduce wear between parts, in the present invention, the oil-free bushing may also be arranged in the rotating shaft hole of the hinge point of the X-shaped hinge, and the grooved rolling bearing is designed on the box body front rotating shaft of the bottom-layer box body. The advantages lie in that: the oil-free bushing is embedded in the rotating shaft hole of the lifting hinge, and the oil-free bushing may realize low-speed self-lubrication and also ensure a requirement of precise fitting at the same time, so that all structures are kept to be connected closely and precisely, a small fitting gap reduces a mounting error and ensures a stable structural dimension, a relative motion between the hinge plate and the rotating shaft is kept smooth, position and state instabilities caused by large deformation due to wear generated by an original bushing-free structure are reduced, and each frame is ensured to be firmer and more stable after mounted, and compared with an existing bearing structure, this structure is more concise, saves amounting space, reduces a processing difficulty and a processing cost, and reduces a mounting difficulty and a qualification requirement for an operator at the same time. The grooved rolling bearing is designed to crossover the slide rail of the support frame slideway limiting plate to assist the lifting of the X-shaped hinge, which greatly reduces lifting resistance, makes the lifting of the box body more smooth, and can also reduce exertion of a gas spring, so that a support effect is achieved by using a smaller gas spring.

In order to improve a safety protection performance, in the present invention, structures such as the oil pressure buffer, the buffer limiting seat, the limiting guide bracket are also designed on the slide limit plate of the support frame, and these structures can play a good protection role, thus ensuring the safe use of the lifting storage device.

REFERENCE NUMERALS OF THE DRAWINGS

Figure 1:
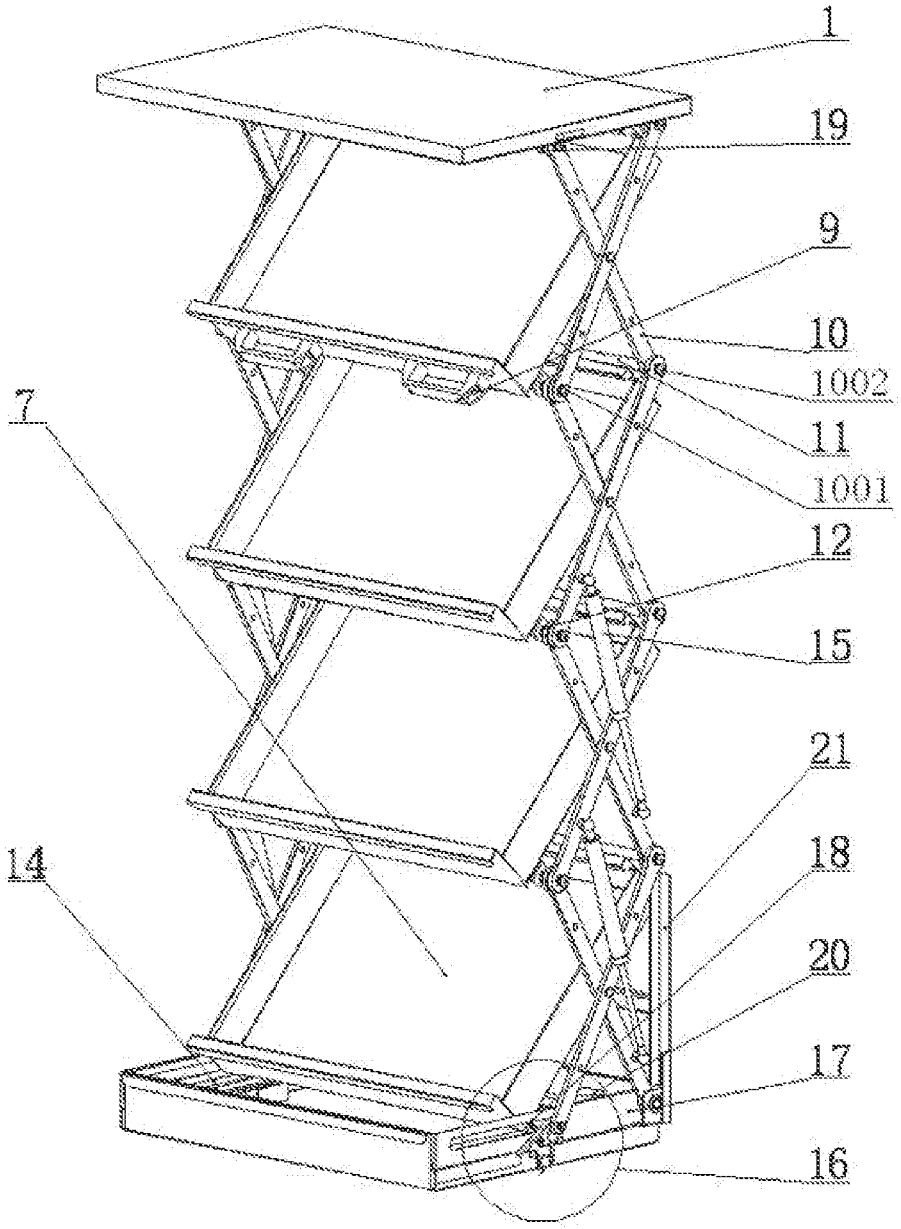
FIG. 1 is a schematic structural diagram of the present invention.
Figure 2:
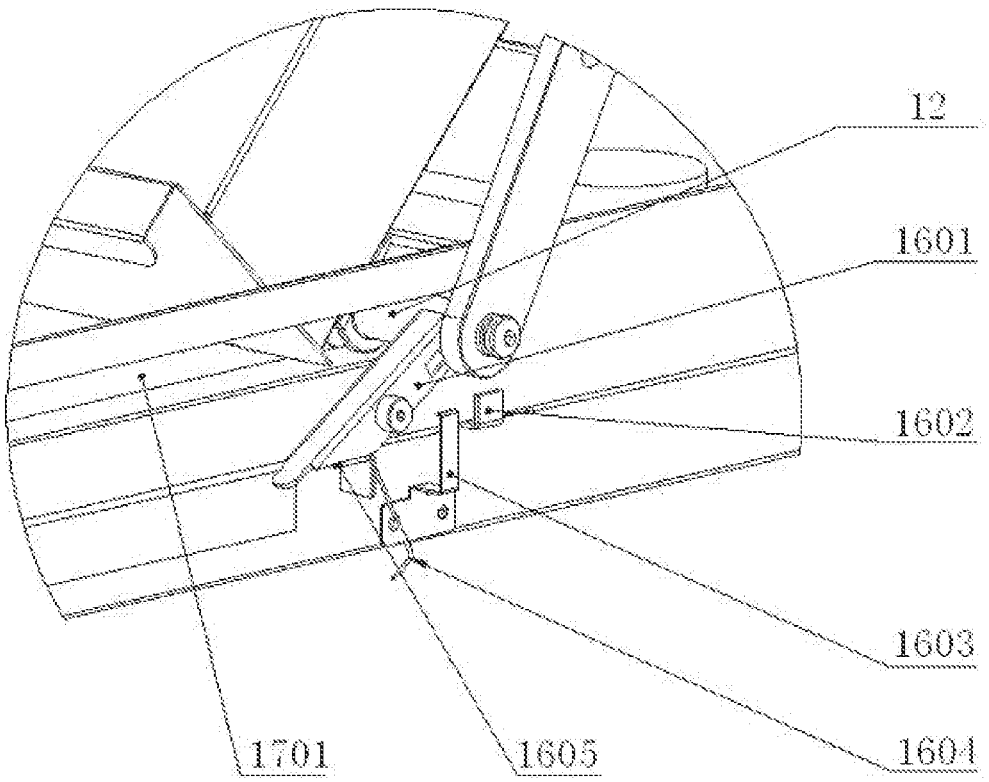
FIG. 2 is a schematic diagram of an enlarged structure of a local part (locking mechanism part) in FIG. 1.
Figure 3:
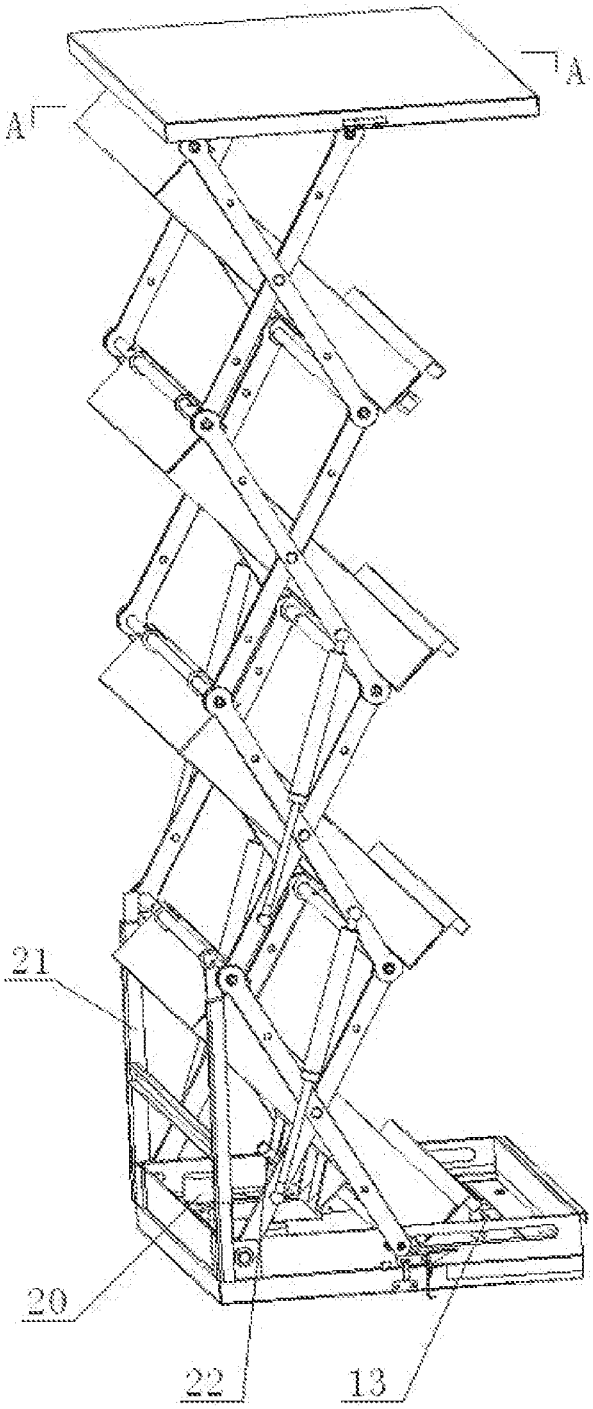
FIG. 3 is a side view of FIG. 1.
Figure 4:
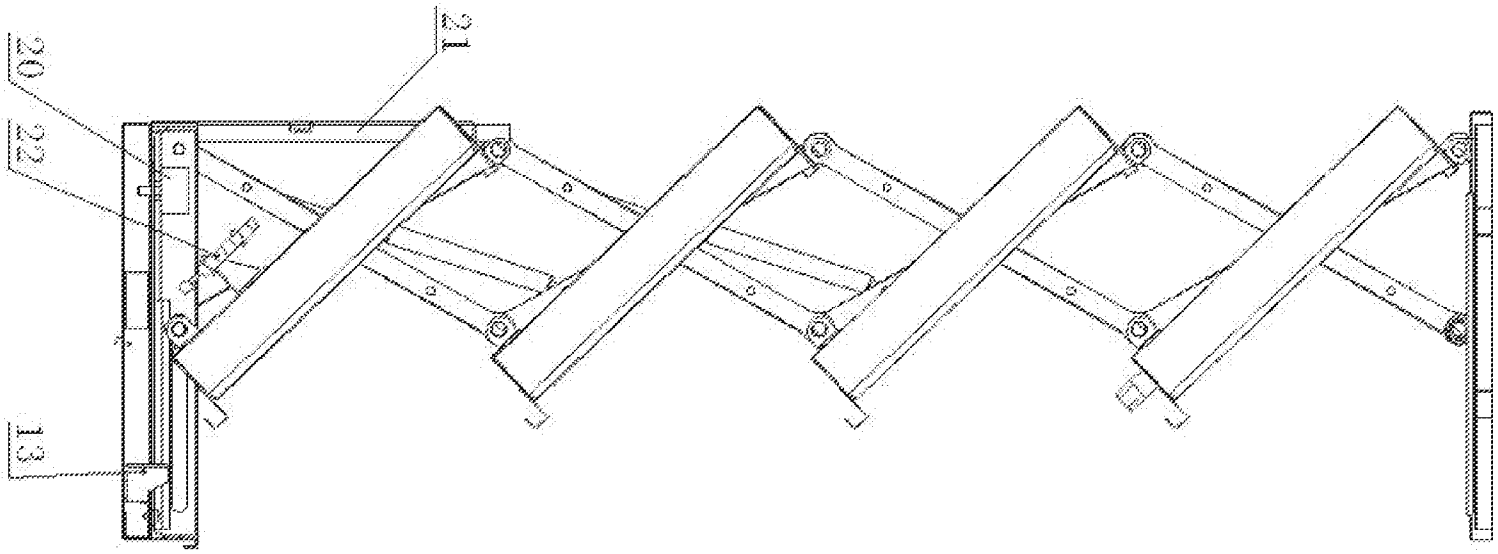
FIG. 4 is a sectional view of A-A in FIG. 3.
Figure 5:
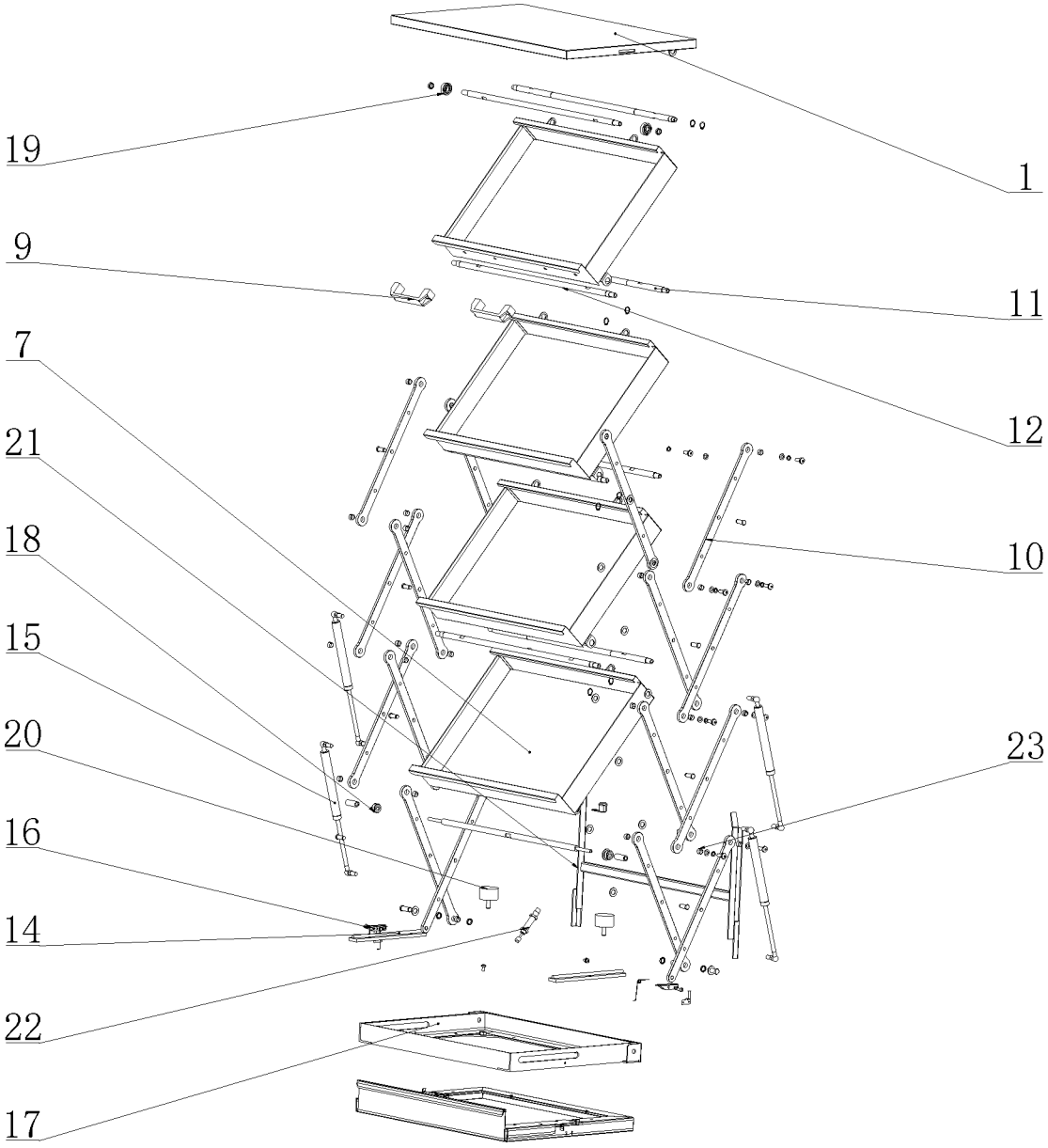
FIG. 5 is an exploded structural diagram of the present invention.

1 refers to upper cover plate, 7 refers to box body, 9 refers to lifting handrail, 10 refers to X-shaped hinge, 1001 refers to front hinge point, 1002 refers to rear hinge point, 11 refers to box body real rotating shaft, 12 refers to box body front rotating shaft, 13 refers to oil pressure buffer impact plate, 14 refers to slide rail, 15 refers to nitrogen spring, 16 refers to locking mechanism, 1601 refers to deadbolt, 1602 refers to spring locking position, 1603 refers to deadbolt hanging plate, 1604 refers to torsion spring, 1605 refers to limiting catch, 17 refers to support frame slideway limiting plate, 1701 refers to slideway, 18 refers to grooved rolling bearing, 19 refers to rolling bearing, 20 refers to buffer limiting seat, 21 refers to limiting guide bracket, 22 refers to oil pressure buffer, and 23 refers to oil-free bushing.

DETAILED DESCRIPTION OF PREFERRED EMBODIMENTS

With reference to FIG. 1 to FIG. 5, a lifting storage device comprises multiple bodies 7 movably stacked up and down, a support frame slideway limiting plate 17 is arranged below a bottom-layer box body 7, X-shaped hinges 10 are symmetrically arranged on two sides of the box body 7 respectively, and a bottom end of the X-shaped hinge 10 is movably connected with the support frame slideway limiting plate 17. As shown in the figures, a slideway 1701 is arranged on the support frame slideway limiting plate 17, a front hinge point 1001 at a bottom end of the X-shaped hinge 10 is movably connected with the slideway 1701, and a rear hinge point 1002 at the bottom end of the X-shaped hinge 10 is fixedly connected with the support frame slideway limiting plate 17.

A box body front rotating shaft 12 and a box body rear rotating shaft 11 are respectively arranged in front of and behind each box body 7 through connecting lugs, two ends of the box body front rotating shaft 12 and the box body rear rotating shaft 11 are respectively connected with the front and rear hinge points of the X-shaped hinges 10 on two sides, and a stable quadrilateral structure is formed between the front and rear rotating shafts and the X-shaped hinge. During mounting, the box body front rotating shaft 12 and the box body rear rotating shaft 11 of each box body 7 are connected with the X-shaped hinge 10 in a staggered manner, wherein the box body front rotating shaft 12 is movably connected with the lower-layer front hinge point 1001 of the X-shaped hinge 10, and the box body rear rotating shaft 11 is movably connected with the upper-layer rear hinge point 1002 of the X-shaped hinge 10, so that each box body 7 may be inclined with the lifting of the X-shaped hinge 10 after mounting. In this structural design, mounting connection of the box body front rotating shaft 12 and the box body rear rotating shaft 11 with the box body 7 and the X-shaped hinge 10 may be designed into movable connection, so as to facilitate maintenance, and more flexible and convenient replacement of the box body 7.

In order to make the lifting more smooth without resistance, an oil-free bushing 23 may be mounted in a rotating shaft hole of the hinge point of the X-shaped hinge 10, and the oil-free bushing 23 is mounted in cooperation with the box body front rotating shaft 12/the box body rear rotating shaft 11, which can realize low-speed self-lubrication and reduce wear, and is more concise and durable than a bearing structure. In addition, a grooved rolling bearing 18 may also be arranged on the box body front rotating shaft 12 of the bottom-layer box body 7, a slide rail 14 is correspondingly mounted on the support frame slideway limiting plate 17, and a semi-circular bearing inner groove of the grooved rolling bearing 18 crosses over the slide rail 14 to roll back and forth, which assists the lifting of the X-shaped hinge 10, thus greatly reducing running resistance.

The X-shaped hinge 10 is provided with a plurality of nitrogen springs 15 for controlling the limiting, one end of each nitrogen spring 15 is connected with a previous hinge, and the other end of each nitrogen spring is connected with a latter hinge. Due to the arrangement of the oil-free bushing, the grooved rolling bearing and other structures capable of reducing the running resistance, the exertion of the nitrogen spring can be reduced, so that a very good support effect can be achieved by a smaller nitrogen spring, thus further reducing a product cost.

A locking mechanism 16 is arranged on the support frame slideway limiting plate 17 corresponding to the X-shaped hinge 10. With reference to the figures, the locking mechanism 16 is arranged in a final position of a slideway 1701 on the support frame slideway limiting plate 17 and comprises a deadbolt 1601, the deadbolt 1601 is movably connected with the support frame slideway limiting plate 17 through a rotating shaft, a torsion spring 1604 is mounted in the deadbolt 1601, one end of the torsion spring 1604 is connected with the deadbolt 1601, the other end of the torsion spring 1604 is connected with a torsion spring clamping position 1602, and a deadbolt hanging plate 1603 and a limiting catch 1605 are also provided corresponding to the deadbolt 1601.

In order to ensure a lifting safety, the device may also be provided with a plurality of safety protection mechanisms. As shown in the figures, a bottom portion of the bottom-layer box body 7 is provided with an oil pressure buffer 22, an oil pressure buffer impact plate 13 is correspondingly arranged on the support frame slideway limiting plate 17, a buffer limiting seat 20 may also be mounted on the support frame slideway limiting plate 17, a rear portion of the support frame slideway limiting plate 17 is provided with a limiting guide bracket 21, and the X-shaped hinge 10 is movably abutted with the limiting guide bracket 21 correspondingly.

A lifting handrail 9 is mounted on a top-layer box body 7 to facilitate pulling.

An upper cover plate 1 may also be mounted above the top-layer box body 7, the box body front rotating shaft 12 and the box body rear rotating shaft 11 may also be mounted below the upper cover plate 1, and a difference lies in that the box body front rotating shaft 12 and the box body rear rotating shaft 11 are connected with the hinge points of the same layer of the X-shaped hinge 10. For convenience of use, the box body rear rotating shaft 11 is connected with the upper cover plate 1 through a connecting lug, while the box body front rotating shaft 12 is not connected with the upper cover plate 1 and is only movably abutted. The box body front rotating shaft 12 may also be provided with a rolling bearing 19 (corresponding to a mounting slide rail on the upper cover plate 1) to assist smooth running, and after such mounting, the box body front rotating shaft 12 and the box body rear rotating shaft 11 may support the upper cover plate 1 during lifting. The upper cover plate 1 is always in a horizontal state and is lifted along with the X-shaped hinge 10, and meanwhile, a front portion of the upper cover plate 1 is not fixed, so that the upper cover plate may be opened upwardly at will.

A working principle is briefly described as follows.

The hand-held lifting handrail 9 is pulled upwardly, and the X-shaped hinge 10 is unfolded upwardly to be lifted, thus driving the plurality of movable box bodies 7 to be lifted. After being lifted, each box body 7 is supported by the box body front rotating shaft 12 and the box body rear rotating shaft 11 to be inclined from rear to front, adjacent box bodies 7 are separated along with each layer of hinges, and an interior of the box body is fully displayed, thus being used as an exhibition board to display articles.

When lifted to a predetermined height, the box body is clamped and fixed through the locking mechanism 16. As shown in the figures, due to an action of the torsion spring 1604, the deadbolt 1601 always keeps in an ordinary state that a tail portion is tilted upwardly. In order to prevent the deadbolt 1601 from being excessively and continuously rotated under a spring force of the torsion spring 1604, the limiting catch 1605 is arranged at a head portion of the deadbolt 1601 for stopping. When the X-shaped hinge 10 is pulled upwardly, the box body front rotating shaft 12 of the bottom-layer box body 7 slides along the slideway 1701, the tilted deadbolt 1601 is pressed down first to reach the final position of the slideway 1701, then the box body front rotating shaft 12 no longer presses the deadbolt 1601, the deadbolt 1601 is tilted upwardly again under the action of the torsion spring 1604, and the box body front rotating shaft 12 is clamped at an edge of the slideway 1701 to be fixed.

When the box body 7 needs to be lowered, the deadbolt 1601 is manually rotated and pressed down, the deadbolt 1601 is hung on a hook of the deadbolt hanging plate 1603, then the deadbolt 1601 is no longer tilted to block the box body front rotating shaft 12, the box body front rotating shaft 12 may slide back along the slideway 1701, and the X-shaped hinge 10 is lowered to restore a horizontally stacked state of the box body 7.

When the X-shaped hinges and the plurality of box bodies are lowered, in addition to damping and buffering functions of the nitrogen spring 15, the oil pressure buffer 22, the oil pressure buffer impact plate 13, the buffer limiting seat 20 and the limiting guide bracket 21 may all play a safety protection role. Before the box body is lowered to be closed, the oil pressure buffer 22 is used to impact the oil pressure buffer impact plate 13, and the oil pressure buffer 22 may well buffer and absorb kinetic energy generated by lowering, thus reducing a degree of accidental injury. The buffer limiting seat 20 is used for buffering an impact force when the X-shaped hinges and the plurality of box bodies are lowered, thus reducing impact noise and playing a buffer protection role. Meanwhile, the buffer limiting seat 20 may also be provided with an adjusting screw, and a stacking height of the folded box bodies may be controlled through the adjusting screw, thus achieving an effect of fine height adjustment. A function of the limiting guide bracket 21 is to further limit left-right deflection of a hinge mechanism after folding, so that a structural state is stable, a position after folding is accurate, and a lowering process is ensured to be safe without interference.

Figure 6:
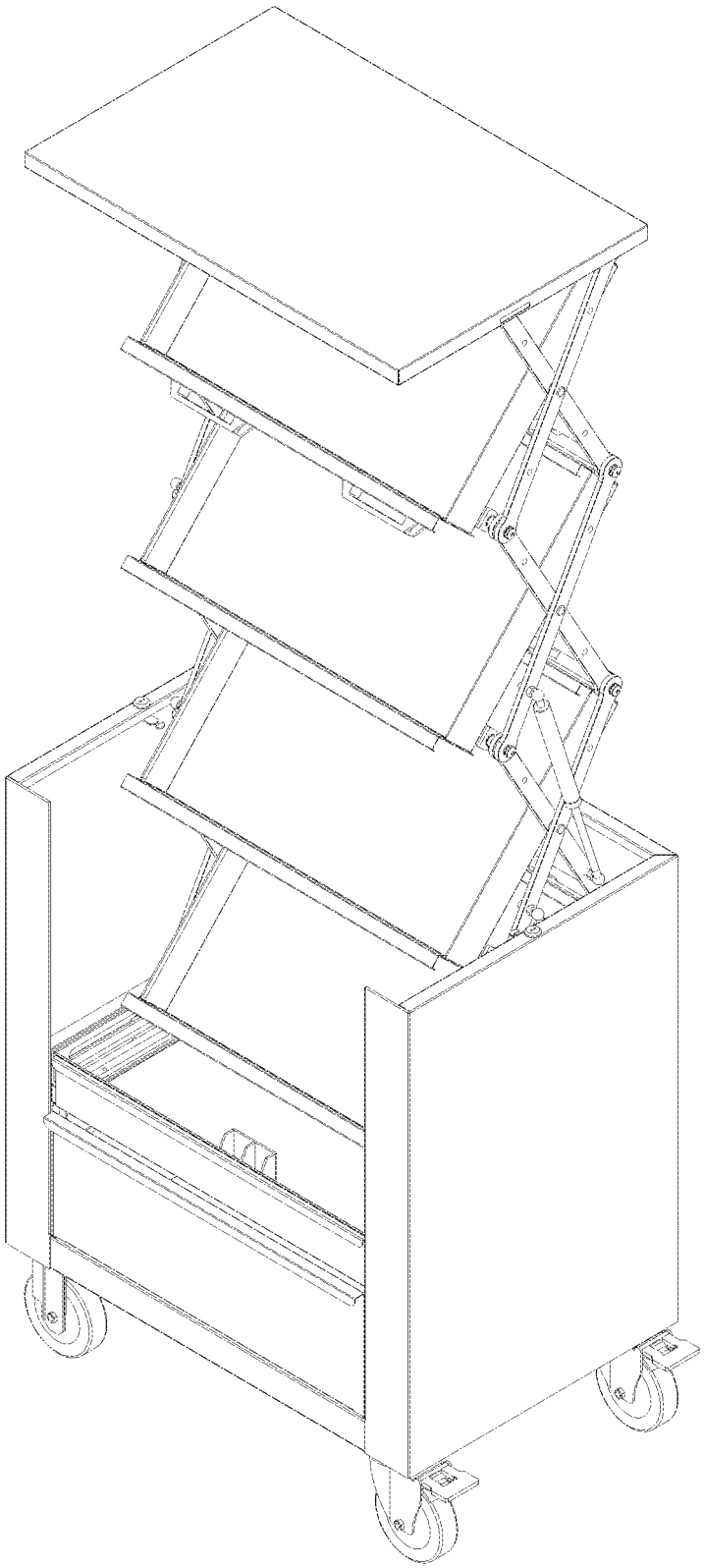
FIG. 6 is a schematic structural diagram of an application of the present invention.
Figure 7:
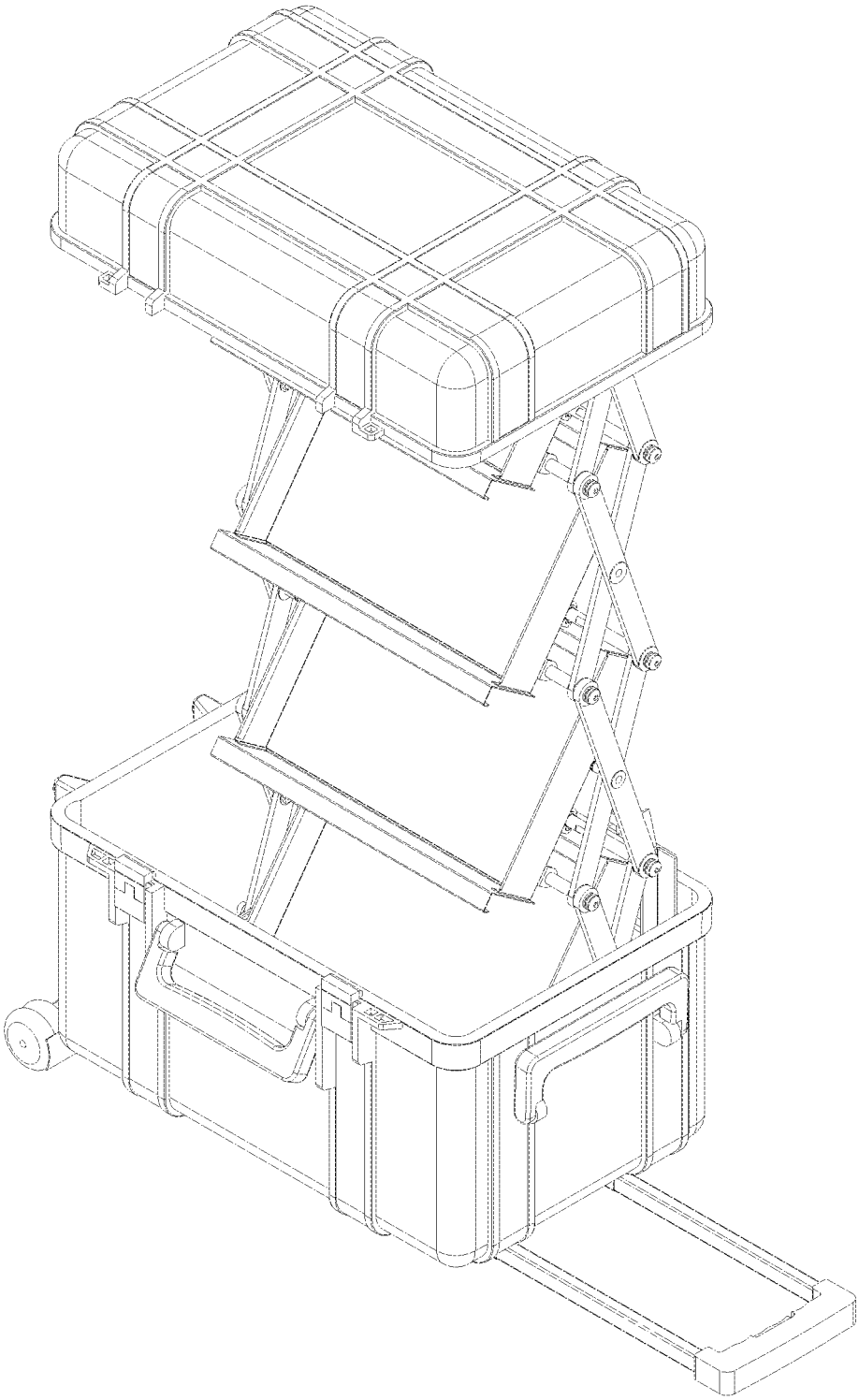
FIG. 7 is a schematic structural diagram of another application of the present invention.

The lifting storage device of the present invention may be used separately or in combination with a tool car or a box body, as shown in FIG. 6 and FIG. 7.

We claim:

1. A lifting storage device, comprising multiple box bodies movably stacked up and down, X-shaped hinges being symmetrically arranged on two sides of each box body, a support frame slideway limiting plate being arranged below a bottom-layer box body, and a bottom end of the X-shaped hinge being movably connected with the support frame slideway limiting plate, wherein a box body front rotating shaft and a box body rear rotating shaft are respectively arranged in front of and behind each box body through connecting lugs, the box body front rotating shaft and the box body rear rotating shaft of each box body are respectively connected with the X-shaped hinges in a staggered manner, wherein two ends of the box body front rotating shaft are movably connected with lower-layer front hinge points of the X-shaped hinges on two sides, and two ends of the box body rear rotating shaft are movably connected with upper-layer rear hinge points of the X-shaped hinges on two sides, and each box body is obliquely lifted along with the X-shaped hinges after the box body front rotating shaft and the box body rear rotating shaft are movably connected with the X-shaped hinges; and a locking mechanism is arranged on the support frame slideway limiting plate corresponding to the X-shaped hinge, the locking mechanism is arranged in a final position of a slideway on the support frame slideway limiting plate, the locking mechanism comprises a deadbolt, a deadbolt hanging plate, a limiting catch and a torsion spring, the deadbolt is movably connected with the support frame slideway limiting plate through a rotating shaft, the deadbolt hanging plate and the limiting catch are arranged corresponding to the deadbolt, and the torsion spring is arranged in the deadbolt.

2. The lifting storage device according to claim 1, wherein an oil-free bushing is arranged in a rotating shaft hole of the hinge point of the X-shaped hinge.

3. The lifting storage device according to claim 1, wherein a grooved rolling bearing is arranged on the box body front rotating shaft of the bottom-layer box body, a slide rail is correspondingly arranged on the support frame slideway limiting plate, and the grooved rolling bearing is movably abutted with the slide rail.

4. The lifting storage device according to claim 1, wherein a bottom portion of the bottom-layer box body is provided with an oil pressure buffer, and an oil pressure buffer impact plate is correspondingly arranged on the support frame slideway limiting plate.

5. The lifting storage device according to claim 1, wherein a buffer limiting seat is arranged on the support frame slideway limiting plate.

6. The lifting storage device according to claim 1, wherein a rear portion of the support frame slideway limiting plate is provided with a limiting guide bracket, and the X-shaped hinge is movably abutted with the limiting guide bracket correspondingly.

* * * * *